US008152281B2

(12) United States Patent
Matsumoto

(10) Patent No.: US 8,152,281 B2
(45) Date of Patent: Apr. 10, 2012

(54) LIQUID EJECTING HEAD AND LIQUID EJECTING APPARATUS

(75) Inventor: Yasuyuki Matsumoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 299 days.

(21) Appl. No.: 12/635,960

(22) Filed: Dec. 11, 2009

(65) Prior Publication Data

US 2010/0156999 A1 Jun. 24, 2010

(30) Foreign Application Priority Data

Dec. 19, 2008 (JP) ..... 2008-323323

(51) Int. Cl.
*B41J 2/045* (2006.01)

(52) U.S. Cl. ..... 347/68

(58) Field of Classification Search ..... 347/68, 347/69, 70–72
See application file for complete search history.

(56) References Cited

U.S. PATENT DOCUMENTS

| | | | | |
|---|---|---|---|---|
| 7,530,673 | B2 * | 5/2009 | Sumi | 347/68 |
| 7,712,878 | B2 * | 5/2010 | Takabe et al. | 347/68 |
| 7,789,495 | B2 * | 9/2010 | Matsumoto et al. | 347/70 |
| 7,909,439 | B2 * | 3/2011 | Hirano et al. | 347/71 |

FOREIGN PATENT DOCUMENTS

JP 2007-026125 2/2007

* cited by examiner

*Primary Examiner* — Kristal Feggins
(74) *Attorney, Agent, or Firm* — Workman Nydegger

(57) ABSTRACT

A liquid ejecting head including a first base member in which a plurality of pressure generating chambers communicating with nozzle openings and a series of partition walls are arranged in parallel, a second base member disposed on the first base member, a reservoir serving as a common liquid chamber for the pressure generating chambers, and an adhesive agent adhered to a first angular portion formed in an end portion of the partition walls near the reservoir which is adjacent to the second base member.

5 Claims, 7 Drawing Sheets

LIQUID EJECTING HEAD AND LIQUID EJECTING APPARATUS

CROSS-REFERENCES AND RELATED APPLICATIONS

The entire disclosures of Japanese Patent Application No. 2008-323323, filed Dec. 19, 2008 is expressly incorporated herein by reference.

BACKGROUND OF THE INVENTION

1. Technical Field

The present invention relates to a liquid ejecting head and a liquid ejecting apparatus. More specifically, the present invention relates to an ink jet type recording head and ink jet type recording apparatus which discharges ink as liquid.

2. Related Art

One ink jet type recording head of a liquid ejecting head currently known in the art uses an actuator having a vibration-mode piezoelectric element. The piezoelectric elements vibrates a vibration plate disposed adjacent to a pressure generating chamber communicating with a nozzle opening causing pressure to be applied to the ink in the pressure generating chamber such that ink droplets are discharged from the nozzle opening.

The ink jet recording head includes a passage forming substrate communicating with the nozzle opening. The passage forming substrate has a plurality of pressure generating chambers which are arranged in parallel and are partitioned by partition walls, a piezoelectric element which is formed by stacking a lower electrode membrane, a piezoelectric layer, and an upper electrode membrane with an insulating membrane disposed between the piezoelectric element and the pressure generating chamber of the passage forming substrate. The insulating membrane functions as a vibration plate, while a reservoir forming substrate includes a reservoir portion which is adhered to the passage forming substrate serves as a common ink chamber of the pressure generating chamber. An example of such a configuration is shown in Japanese Patent Document JP-A-2007-26125.

An ink supply path for supplying ink in the reservoir portion to the respective pressure generating chamber is provided to the respective pressure generating chamber. The respective ink supply paths are formed by extending the partition walls disposed at both sides of width direction of the respective pressure generating chamber. Furthermore, an upper surface of each partition wall is adhered to a reservoir forming substrate with the vibration plate formed there between, and an under surface of each partition wall is adhered to a nozzle plate.

One problem with the ink jet type recording head according to this configuration, however, is that the difference in the linear expansion coefficient between the passage forming substrate and the nozzle plate causes bending stress over the whole passage forming substrate. This stress is particularly strong at one of the weakest areas of the passage forming substrate, near the end portion of the partition walls of the ink supply path. The stress may result in breaks and damaged recording heads.

Also, the bending stress that causes a surface of the nozzle plate to become concave, causing increased stress as the partition wall is pulled by the nozzle plate, and as a result, the vibration plate may become cracked and broken.

As mentioned above, the vicinities of end portions of the partition walls partitioning the pressure generating chambers are apt to be broken by the bending stress, so that the quality and performance of the ink jet recording head may be deteriorated. This difficulty exists not only in the ink jet type recording head discharging ink but also in other liquid ejecting heads discharging liquid other than ink.

BRIEF SUMMARY OF THE INVENTION

An advantage of an aspect of the invention is to provide a liquid ejecting head and a liquid ejecting apparatus with partition walls partitioning the pressure generating chambers and vibration plate which are more resistant.

A first aspect of the invention is a liquid ejecting head including a first base member including a plurality of pressure generating chambers communicating with respective nozzle openings from which liquid is ejected, and a plurality of parallel partition walls which partition the pressure generating chambers. The liquid ejecting head also includes a second base member disposed on one surface of the first base member, a reservoir serving as a common liquid chamber for the pressure generating chambers, and an adhesive agent adhered to a first angular portion formed in an end portion of the partition walls near the reservoir which is adjacent to the second base member.

One advantage of the first aspect of the invention is that the adhesive agent is provided to the first angular portion of the partition wall such that any stress applied to the first angular portion is relieved. Therefore, the adhesive agent is able to protect the front end portion of the partition wall, which are typically vulnerable to destruction caused by the stress. Consequently, though stress is applied to the front end portion of the partition wall, the stress is relieved to prevent the front end portion from being broken. Furthermore, the adhesive agent is also able to prevent cracks from being generated in the second base member, even though the partition wall and even the second base member are pulled by bending condition.

Another aspect of the invention us a liquid ejecting apparatus includes the liquid ejecting head described above. With the aspect, a liquid ejecting apparatus having an excellent durability can be provided.

A third aspect of the invention is a liquid ejecting head comprising a first base member including a plurality of pressure generating chambers communicating with respective nozzle openings from which liquid is ejected, a flow passage communicating with the pressure generating chambers, and a plurality of parallel partition walls which partition the pressure generating chambers and flow passage. The liquid ejecting head also includes a second base member disposed on one surface of the first base member, a reservoir serving as a common liquid chamber for the pressure generating chambers which communicates with the pressure generating chambers via the flow passage, and an adhesive agent adhered to a first angular portion formed in an end portion of the partition walls near the reservoir which is adjacent to the second base member and a second angular portion formed in the partition walls partitioning the flow passage which is adjacent to the second base member, wherein the first angular portion and second angular portion have groove portions formed therein which cause the adhesive agent to flow from the first angular portion to the second angular portion using capillary action.

One advantage of the third aspect of the invention is that the groove portions of the first and second angular portions assist in the distribution of the adhesive agent so as to simplify the manufacturing processes used to manufacture the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail with reference to drawings.

First Embodiment

Figure 1:
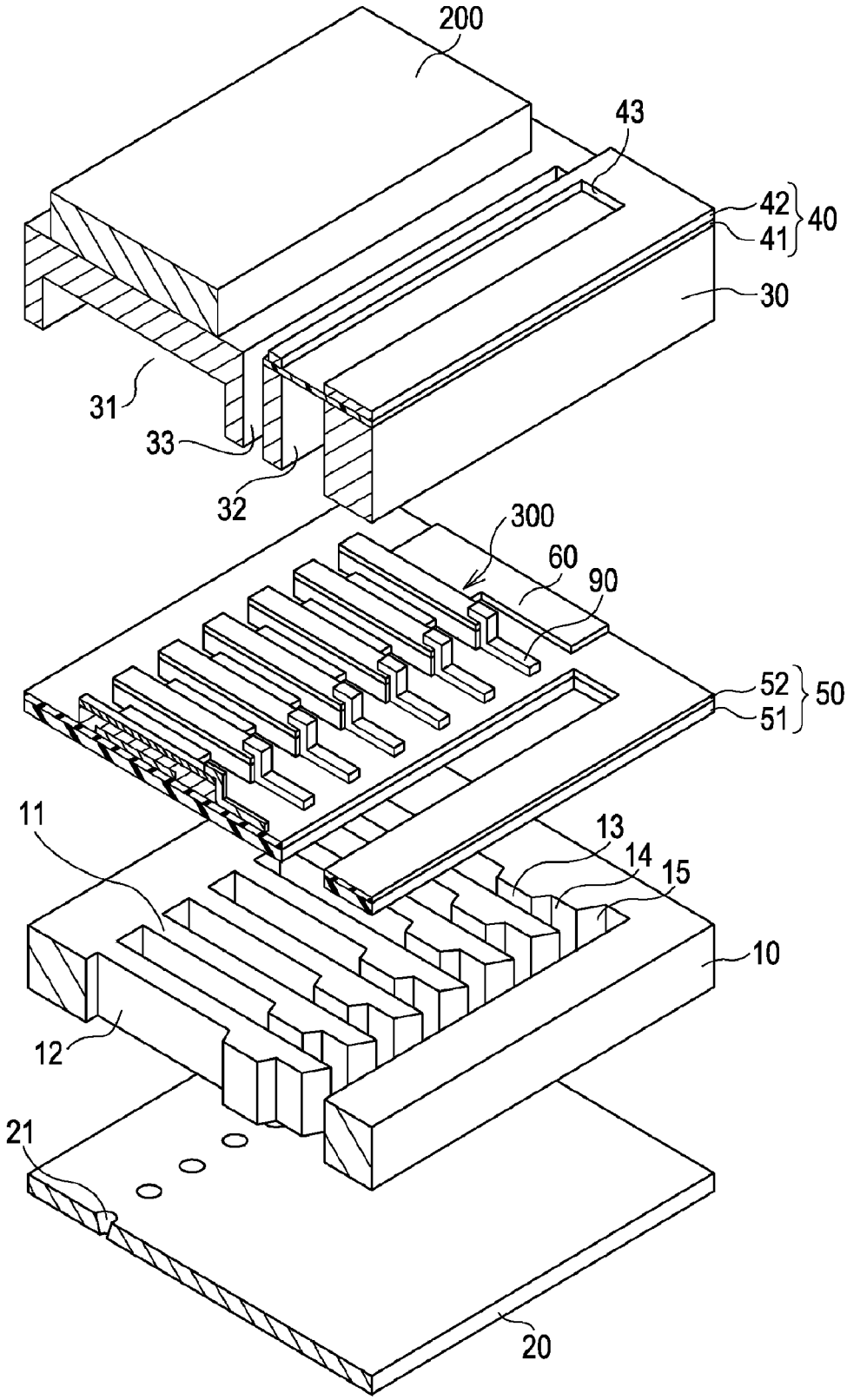
FIG. 1 is an exploded perspective view of an ink jet recording head according to a first embodiment of the invention.
Figure 2A:
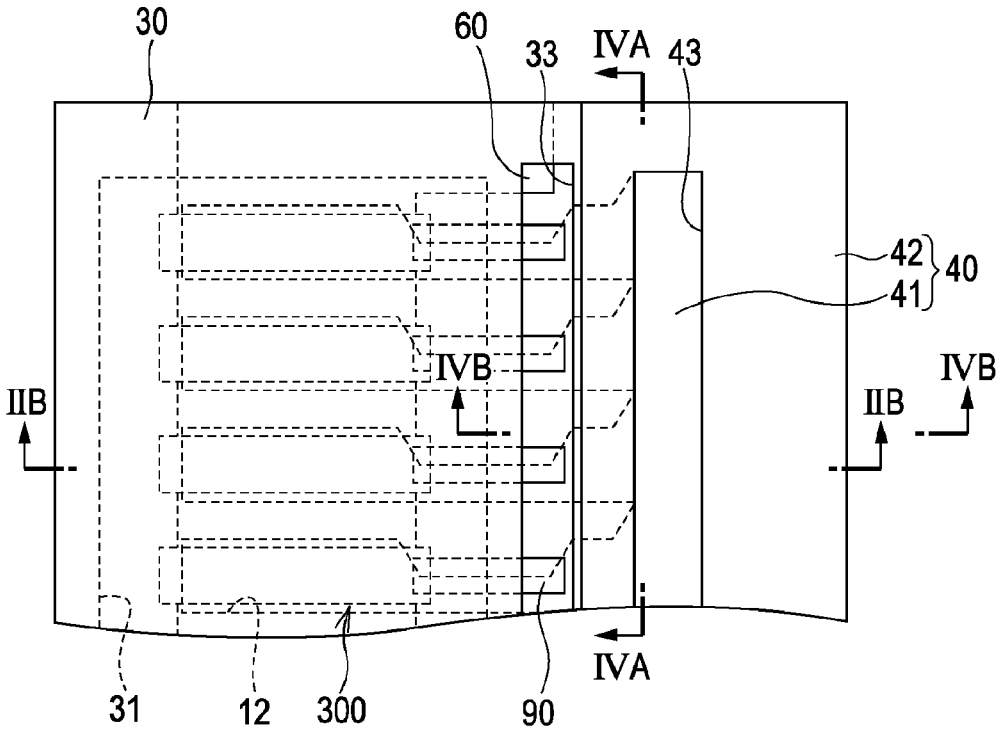
FIG. 2A is a plan view of the ink jet recording head of the first embodiment of the invention.
Figure 2B:
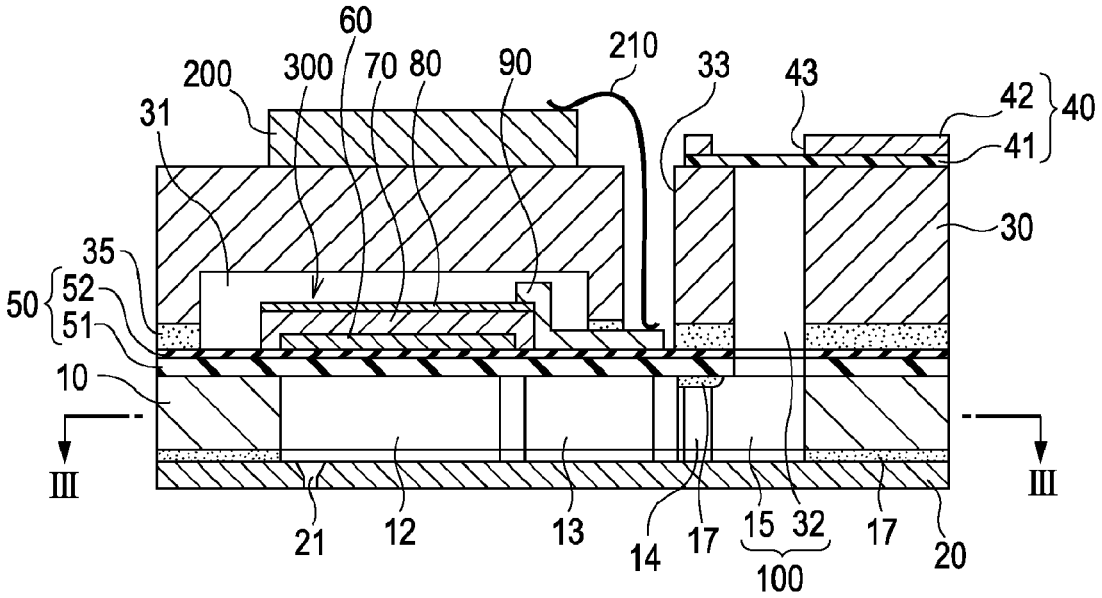
FIG. 2B is a cross-sectional view of the ink jet recording head of the first embodiment of the invention.
Figure 3:
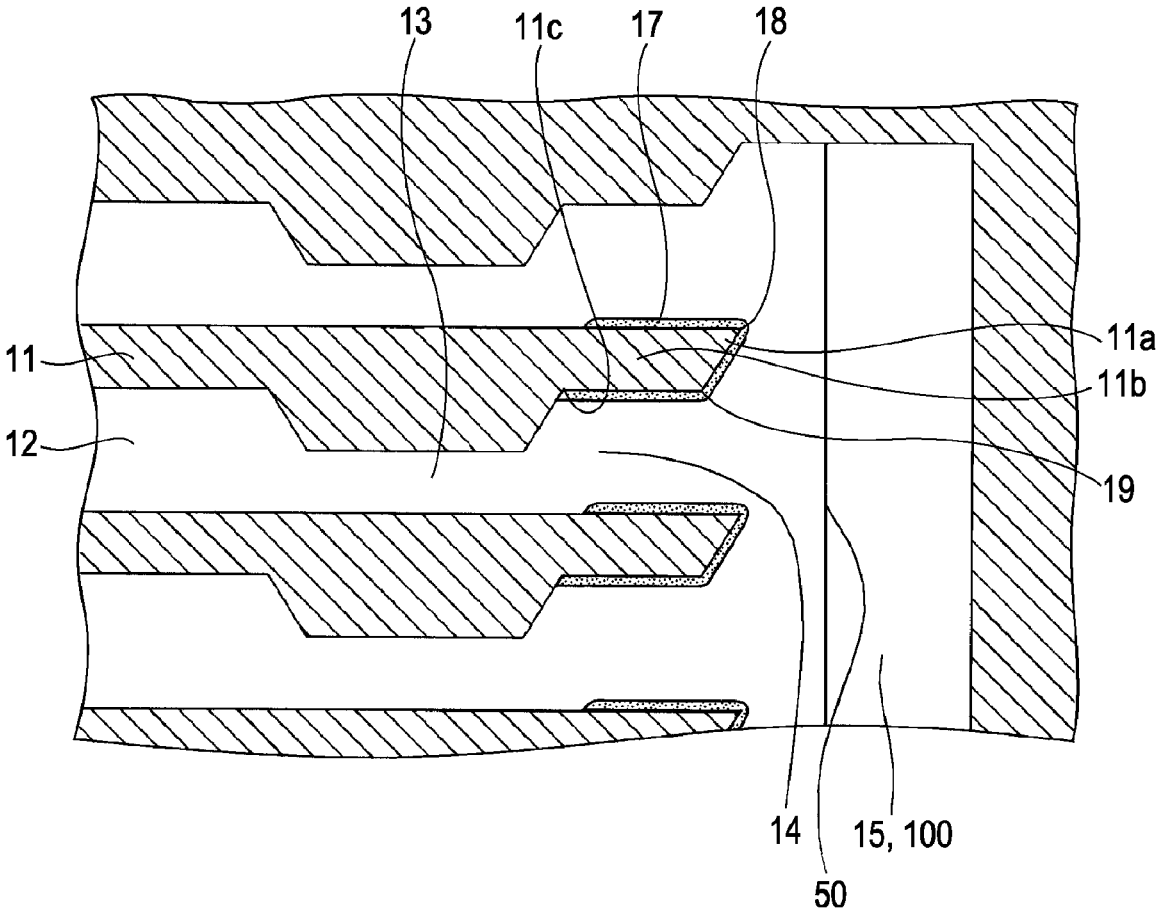
FIG. 3 is a cross-sectional view of the ink jet recording head of the first embodiment of the invention.
Figure 4A:
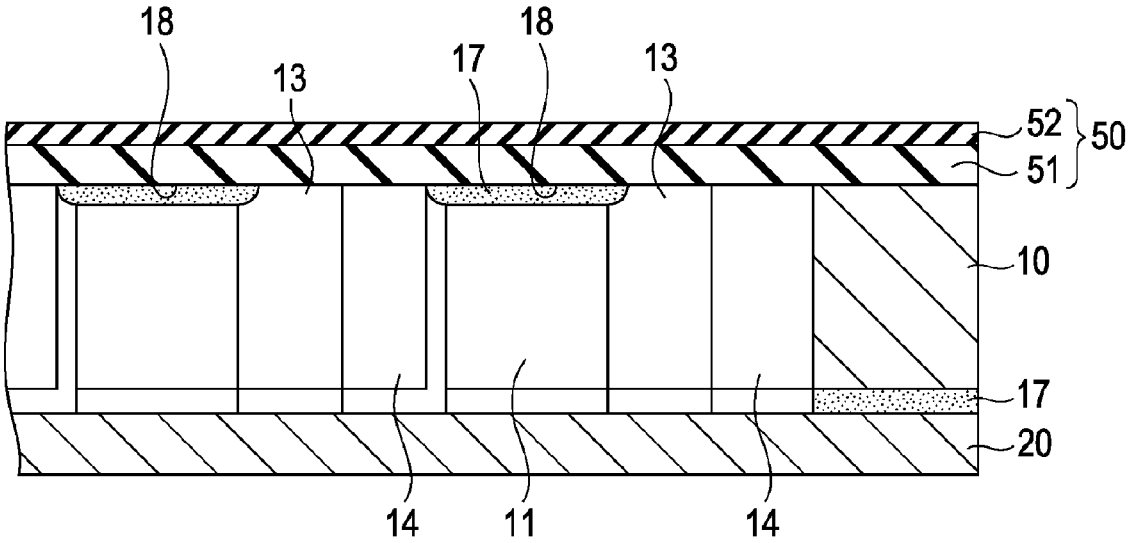
FIG. 4A is a cross-sectional view of an ink jet recording head of the first embodiment of the invention.
Figure 4B:
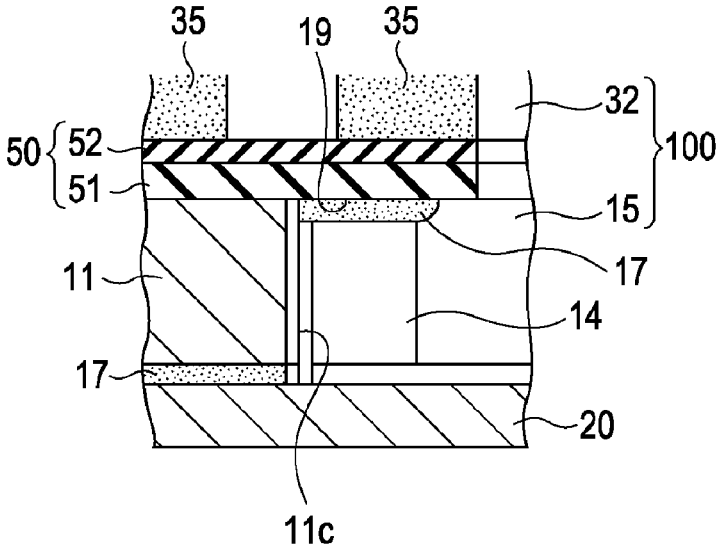
FIG. 4B is a cross-sectional view of an ink jet recording head of the first embodiment of the invention.

FIG. 1 is an exploded perspective view showing a schematic structure of an ink jet recording head that is one example of a liquid ejecting head related to the embodiment of the invention, FIG. 2A is a plan view of FIG. 1, FIG. 2B is a cross-sectional view taken along a line IIB-IIB of the FIG. 2A, FIG. 3 is a cross-sectional view taken along line a III-III of the FIG. 2B, FIG. 4A is a cross-sectional view taken along a line IVA-IVA of the FIG. 2A, FIG. 4B is a cross-sectional view taken along a line IVB-IVB of the FIG. 2A.

As shown in the drawings, a passage forming substrate 10 that is an example of a first base member is made of a silicon single crystal substrate in which the crystals are oriented to a plane direction (110). An elastic membrane 51 formed of an oxide film is provided on one surface of the passage forming substrate 10. The passage forming substrate 10 includes a plurality of parallel pressure generating chambers 12 partitioned by partition walls 11 which are arranged in a width direction. The upper surface of the pressure generating chambers 12 is provided by the elastic membrane 51.

Communicating passages 14 and ink supply paths 13 which communicate with the respective pressure generating chambers 12 which are partitioned by the partition walls 11 are formed at longitudinal end portions of the respective pressure generating chambers 12 in the passage forming substrate 10. A communicating portion 15 communicating with each of communicating passages 14 is formed adjacent to the communicating passages 14. The communicating portion 15 communicates with a reservoir portion 32 of a reservoir forming substrate 30, described more fully below, in order o form a reservoir 100 which serves as a common ink chamber for the pressure generating chambers 12.

Here, the ink supply path 13 has a smaller cross sectional area than that of the pressure generating chamber 12, which keeps constant flow resistance of ink between the pressure generating chamber 12 and the communicating portion 15. In one embodiment, the ink supply paths 13 are formed by narrowing the width of the passage between the reservoir 100 and each pressure generating chamber 12 by extending one side of the partition wall 11 so that the pressure generating chamber 12 has a narrower width.

Although in this embodiment the ink supply path 13 is formed by narrowing the width of the passage from one side of the passage, it is also possible to form the ink supply path 13 by narrowing the width of the passage from both sides. Furthermore, the ink supply path 13 can be also formed by narrowing the passage from a thickness direction of the passage instead of by narrowing the width of the passage. Each communicating passage 14 is partitioned by the partition walls 11 and is formed by extending the partition walls 11 inwards towards the pressure generating chamber 12 so as to form a space between the ink supply path 13 and the communicating portion 15.

In addition, even though the silicon single crystal substrate is used as a material for manufacturing the passage forming substrate 10 in the present embodiment, the material is not limited to the silicon single crystal substrate, and, for example, glass ceramics can be also used.

A nozzle plate 20 in which nozzle openings 21 are formed so as to communicate with the respective pressure generating chambers 12 is fixed to a passage surface of the passage forming substrate 10 by use of adhesive agent 17. The nozzle plate 20 is formed of, for example, glass ceramics, silicon single crystal substrate, stainless steel.

Meanwhile, a piezoelectric elements 300 are provided on the passage surface of the passage forming substrate 10 with a vibration plate 50 formed there between.

The piezoelectric elements 300 and the vibration plate 50 which are driven to vibrate by the piezoelectric elements 300 are referred to collectively as an actuator. In the present embodiment, the elastic membrane 51 is provided on the passage forming substrate 10 as described above. An insulation membrane 52 is formed on the elastic membrane 51. The insulation membrane 52 is formed of a material which is different from the elastic membrane 51, such as, for example, an oxide film formed of titanium oxide (TiOx). The elastic membrane 51 and the insulating membrane 52 together constitute the vibration plate 50. Also, the vibration plate 50 is integrally formed with the passage forming substrate 10 instead of adhesion by adhesive agent.

A partition wall 11 of a pressure generating chamber 12 includes a front end portion 11*a* whose width becomes smaller on the side toward the reservoir 100. The front end portion 11*a* of the partition wall 11 and the vibration plate 50 form a first angular portion 18, and the vibration plate 50 and a region 11*b* which partitions the communicating passage 14 of the partition wall 11 form a second angular portion 19. Here, the front end portion 11*a* of the partition wall 11 is not limited so as to have the acute angle as described in the present embodiment, however it represents an end portion facing the reservoir 100.

An adhesive agent 17 is continuously applied from the first angular portion 18 to the second angular portion 19. The adhesive agent 17 applied to the first angular portion 18 gives fillet effect, so the adhesive agent 17 relieves stress on the first angular portion 18. According to this, though the front end portion 11*a* has a narrower width in the partition wall 11 and is vulnerable to stress destruction, the adhesive agent 17 protects the front end portion 11*a*. Therefore, even if the front end portion 11*a* of the partition wall 11 is stressed by the bending of the nozzle plate 20, the stress can be relieved to prevent destruction of the front end portion 11*a*. Even though the partition wall 11 and the vibration plate 50 are pulled by bending of the nozzle plate 20, the adhesive agent 17 relieves the stress and prevents occurrence of cracks in the vibration plate 50.

Since the adhesive agent 17 is also applied to the second angle portion 19, it prevents occurrence of cracks in a region 11*b* partitioning the communicating passage 14 of the partition wall 11 and the vibration plate 50 around the region 11*b*. Additionally, in the present embodiment, a passage partitioned by the adjacent partition walls 11 comprises a communicating passage 14, and the passage can include the ink supply path 13. In this case, the second angular portion 19 is more firmly adhered by the adhesive agent 17, so that it prevents occurrence of cracks more securely.

Furthermore, since the adhesive agent 17 is continuously applied from the first angular portion 18 to the second angular portion 19, the first angular portion 18 and the second angular portion 19 are more firmly attached to the adhesive agent 17, so that the front end portion 11*a* and region 11*b* of the partition wall 11 can be more securely protected. Even though cracks are formed in the vibration plate 50 in the areas of the first angular portion 18 and the second angular portion 19, the first angular portion 18 and the second angular portion 19 are covered with the adhesive agent 17. Therefore, penetration of the ink stored in the reservoir 100 into the cracks of the vibration plate 50 does not occur.

As mentioned above, since the areas of the front end portion 11*a* and the region 11*b* of the partition wall 11 and the vibration plate 50 at are protected from being cracked, an ink jet recording head with a high durability can be provided.

Furthermore, in the present embodiment, the adhesive agent 17 is made of epoxy resin or the like, and is applied to a surface of the nozzle plate 20. When the nozzle plate 20 is adhered to the passage forming substrate 10, the adhesive agent 17 flows along a boundary portion 11*c*, which is a portion between the ink supply path 13 and the communicating passage 14. Thus, the adhesive agent reaches the second angular portion 19, the first angular portion 18, and the vibration plate 50 disposed at opposite side of the nozzle plate 20. The adhesive agent 17 flows due to a capillary phenomenon until it becomes hardened. That is, the adhesive agent 17 is continuously provided from the boundary portion 11*c* to the first angular portion 18. Thus, the adhesive agent 17 does not easily detach from the vibration plate 50 as compared with the case where the adhesive agent 17 is provided only at the first angular portion 18 or only from the first angular portion 18 to the second angular portion 19. As a result, the angular portion 18 can be more securely protected by the adhesive agent 17. When the nozzle plate 20 is adhered to the passage forming substrate 10, the adhesive agent 17 arrives at the first angular portion 18 by the capillary phenomenon, therefore it is not necessary to separately perform an adhesive agent applying process from the boundary portion 11*c* to the first angular portion 18, so that it is possible to efficiently manufacture the liquid ejecting head, reducing the costs associated with manufacturing.

In addition, it is also possible to provide grooves in the front end portion 11*a* or the region 11*b* of the partition wall 11 in the width direction. Using the grooves, the adhesive agent 17 applied on the nozzle plate 20 causing the adhesive agent 17 to flows to the vibration plate 50 by the capillary phenomenon.

The piezoelectric element 300, which is made up of a lower electrode membrane 60, a piezoelectric layer 70 and an upper electrode membrane 80, is provided on the vibration plate 50, which forms a second base member. Here, the piezoelectric element 300 includes a portion having the lower electrode membrane 60, the piezoelectric layer 70 and the upper electrode membrane 80. In general, one electrode of the piezoelectric element 300 is used as a common electrode, while an electrode on the other side of the piezoelectric layer 70 acts an individual electrode for each pressure generating chamber 12.

In the present embodiment, the lower electrode membrane 60 is used as a common electrode of the piezoelectric element 300, and the upper electrode membrane 80 is used as an individual electrode of the piezoelectric element 300, however the opposite configuration can be used in accordance with a specific driving circuit or a wiring condition. Here, the piezoelectric element 300 and the vibration plate 50 of the piezoelectric element 300 are referred to collectively as an actuator. Additionally, in the above described example, while the elastic membrane 51 and the insulating membrane 52 function as the vibration plate 50, the vibration plate 50 is not limited to this configuration and other configurations may be used. For example, only the lower electrode membrane 60 may function as the vibration plate without the elastic membrane 51 and the insulating membrane 52. The elastic membrane 51, the insulating membrane 52 and the lower electrode membrane 60 may function as the vibration plate. Furthermore, the piezoelectric element 300 itself may substantially function as the vibration plate.

The piezoelectric layer 70 is made of a piezoelectric material, which has an electro-mechanical transduction function, and is more particularly made of a ferroelectric material having a perovskite structure. The piezoelectric layer is provided on the lower electrode membrane 60. It is preferable that the piezoelectric layer 70 is formed from, for example, the ferroelectric material such as lead zirconate titanate (PZT), or the ferroelectric material including metal oxide such as niobium oxide ($Nb_2O_5$), nickel oxide (NiO), magnesium oxide (MgO). Specifically, lead titanate (PbTiO), lead zirconate titanate (Pb(Zr, Ti) O), lead zirconate (PbZrO), lanthanum lead titanate ((Pb, La), TiO), lanthanum lead titanate zirconate ((Pb, La) (Zr, Ti) O) and lead titanate zirconate niobate magnesium (Pb(Zr, Ti) (Mg, Nb) O) or the like may be used.

Lead electrodes 90 are connected to the corresponding upper electrode membrane 80 that acts as the individual electrode of the piezoelectric element 300. The lead electrode 90 is made of, for example, gold (Au), and extends from the area near the end portion of the ink supply path 13 to the insulating membrane 52.

A reservoir forming substrate 30 having a reservoir portion 32 which constitutes at least a portion of the reservoir 100 is adhered with intervention of adhesive agent 35 on the passage forming substrate 10 which has the piezoelectric element 300 formed thereon, that is, on the lower electrode membrane 60, the insulating membrane 52 and the lead electrode 90. In the present invention, the reservoir portion 32 passes through the reservoir forming substrate 30 in the thickness direction and extends in the width direction of the pressure generating chambers 12, and as described above, communicates with the communicating portion 15 of the passage forming substrate 10. The reservoir portion 32 and the communicating portion 15 together comprise the reservoir 100, which acts as a common ink chamber of the pressure generating chambers 12.

Additionally, a piezoelectric element holding portion 31 with a sufficient space so as not to hinder movement of the piezoelectric element 300 is formed in a region of the reservoir forming substrate 30 facing the piezoelectric element 300. As long as the piezoelectric element holding portion 31 includes enough space so as not hinder the movement of the piezoelectric element 300, it does not matter whether the space is sealed or not.

It is desirable to use a material having approximately the same coefficient of thermal expansion with that of the passage forming substrate 10, such as glass or ceramic materials is used to form the reservoir forming substrate 30. In the present embodiment, a silicon single crystal substrate of a material which is identical to that of the passage forming substrate 10 is used.

The reservoir forming substrate 30 also includes a through-hole 33 that extends through the reservoir forming substrate 30 in the thickness direction. An end portion of the lead electrode 90 extending from the respective piezoelectric elements 300 is exposed in the through-hole 33.

A driving circuit 200 for driving the piezoelectric elements 300 is fixed on the reservoir forming substrate 30. As the driving circuit 200, for example, a circuit board or a semiconductor integrated circuit (IC) may be used. The driving circuit 200 is electrically connected to the lead electrode 90 by a connection wiring 210 formed of a conductive wire such as a bonding wire.

A compliance substrate 40, which includes a sealing membrane 41 and a fixing plate 42, is adhered on the reservoir forming substrate 30*a*. Here, the sealing membrane 41 is formed of a material with a low rigidity and which has a flexibility (e.g., polyphenylene sulfide (PPS) film), and seals one surface of the reservoir portion 32. The fixed plate 42 is formed of a hard material, such as metal (for example, stainless steel (SUS)). Since a region of the fixed plate 42 facing the reservoir 100 forms an opening 43, one side surface of the reservoir 100 is sealed by the flexible sealing membrane 41.

In the ink jet recording head of the present embodiment, ink is introduced through an ink inlet port connected to an external ink supply unit (not shown), and then, the inside portion from the reservoir 100 to the nozzle orifice 21 is filled with the ink. Then, according to a recording signal from the driving circuit 200, a voltage is applied between the lower electrode membrane 60 and the upper electrode membrane 80 corresponding to each of the pressure generating chambers 12. Accordingly, the elastic membrane 51, the insulating membrane 52, the lower electrode membrane 60 and the piezoelectric layer 70 are bent, so that the pressure in the respective pressure generating chambers 12 increases so as to eject ink droplets from the nozzle opening 21.

Second Embodiment

Figure 5:
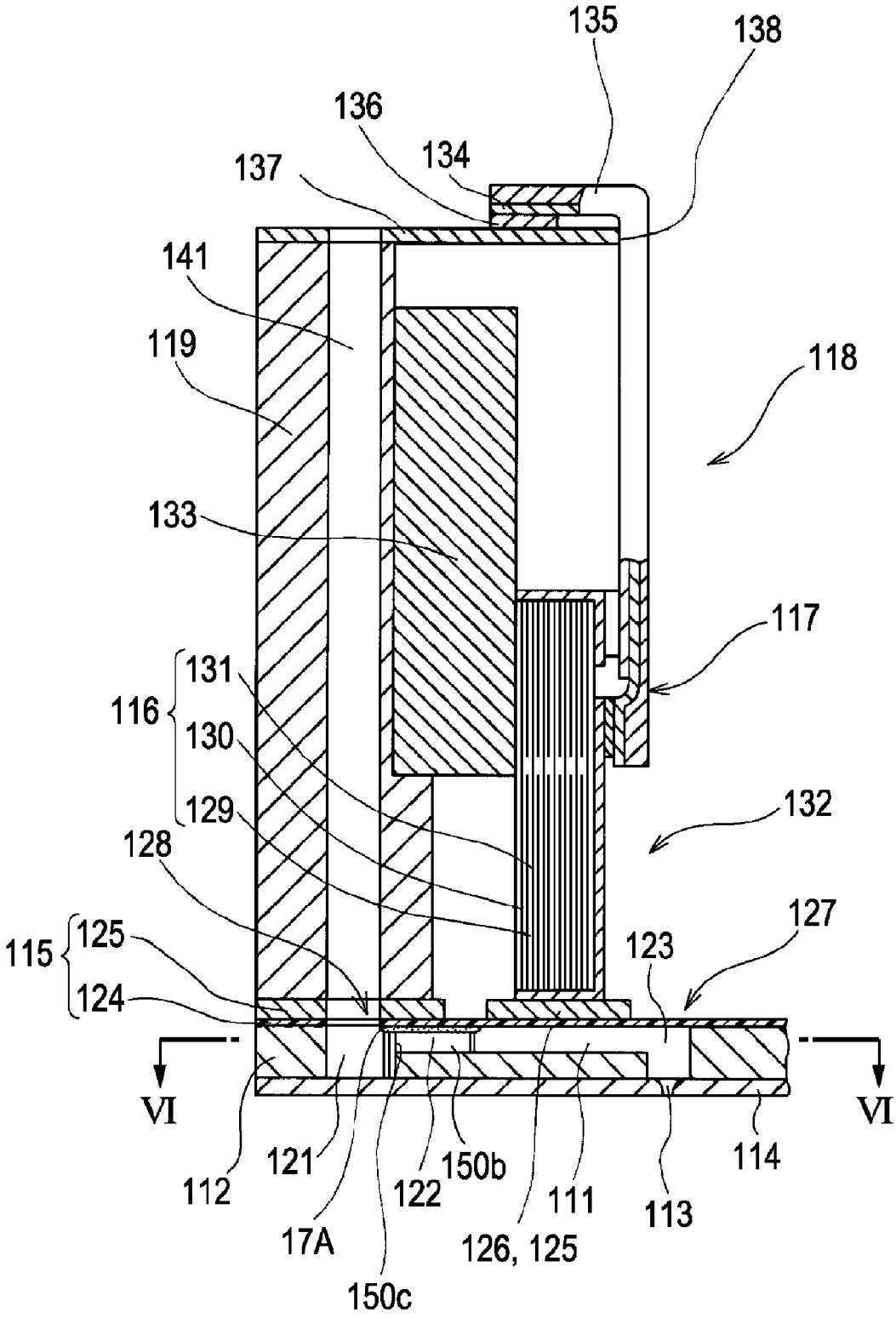
FIG. 5 is a cross-sectional view of an ink jet recording head according to a second embodiment of the invention.

In the first embodiment, the ink jet recording head has a piezoelectric element 300 which is capable of bending, but the invention is not limited to this embodiment, and, for example, it can be applied to a vertical vibration type ink jet recording head. FIG. 5 is a cross-sectional view of an ink jet recording head related to a second embodiment, and FIG. 6 is a cross-sectional view taken along a line VI-VI of the FIG. 5.

Figure 6:
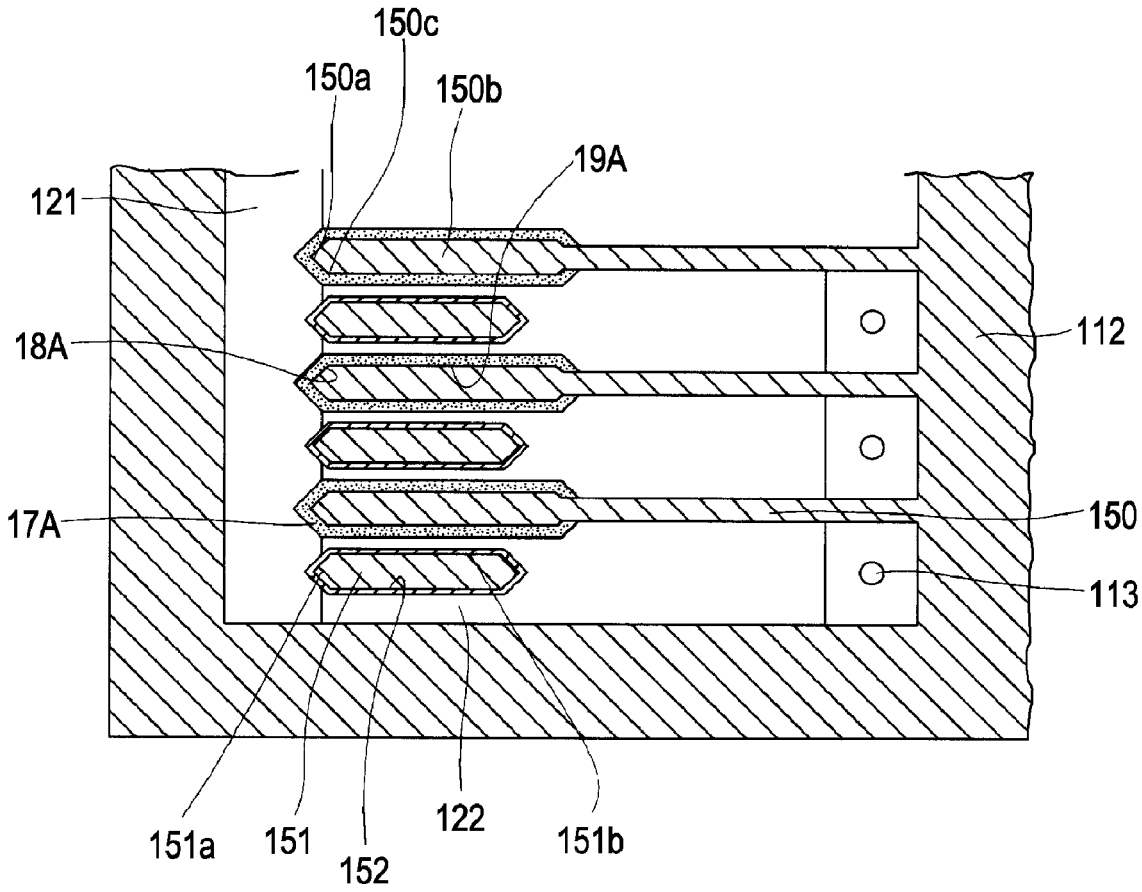
FIG. 6 is a cross-sectional view of the ink jet recording head of the second embodiment of the invention.

As shown in FIGS. 5 and 6, an ink jet recording head of the second embodiment includes a passage forming substrate 112 having a plurality of pressure generating chambers 111, a nozzle plate 114 having a plurality of nozzle openings 113 which communicate with the respective pressure generating chambers 111, a vibration plate 115 disposed on a surface of the passage forming substrate 112 opposite to the nozzle plate 114, a piezoelectric element unit 117 having piezoelectric elements 116 disposed on the vibration plate 115 at a region corresponding to the respective pressure generating chambers 111, and a head case 119 which is fixed to the vibration plate 115 and which includes a receiving portion 118 for receiving the piezoelectric element unit 117.

A plurality of pressure generating chambers 111 which are partitioned by partition walls 150 are arranged in parallel to the width direction on one surface of the passage forming substrate 112 which forms a first base member. For example, in the present embodiment, the pressure generating chambers 111 are arranged in parallel in the passage forming substrate 112. A reservoir 121 for supplying ink to the respective pressure generating chambers 111 is formed in the thickness direction of the passage forming substrate 112 in an area adjacent to the pressure generating chambers 111. The reservoir 121 communicates with the respective pressure generating chambers 111 via an ink supply path 122. In the present embodiment, the ink supply path 122 is formed to have a narrower width than that of the pressure generating chambers 111, and thus the flow resistance of the ink flowing from the reservoir 121 into the pressure generating chambers 111 can be kept constant.

Island-shaped wall portions 151 extending to the ink flow are provided in the corresponding ink supply path 122 of the passage forming substrate 112. By the island-shaped wall portions 151, area of ink passage in the ink supply path 122 becomes narrower, so it can prevent pressure reduction in the pressure generating chambers 111.

Moreover, a nozzle communicating hole 123 extending through the passage forming substrate 112 is adjacent to the pressure generating chamber 111 opposite to the reservoir 121. The reservoir 121 communicates with an ink introduction path 141 formed to penetrate the head case 119 in the width direction. The ink introduction path 141 is a passage that introduces ink from an ink cartridge (not shown) to the reservoir 121. In other words, a liquid passage constituted by the reservoir 121, the ink supply path 122, the pressure generating chamber 111 and the nozzle communicating hole 123 is formed on the passage forming substrate 112.

In the present embodiment, the passage forming substrate 112 is made of a silicon single crystal substrate, and the pressure generating chambers 111 provided on the passage forming substrate 112 are formed by etching the passage forming substrate 112.

On one surface of the passage forming substrate 112, the nozzle plate 114 having the nozzle openings 113 formed therein is adhered by adhesive agent, and the respective nozzle openings 113 communicate with the respective pressure generating chamber by way of the nozzle communicating hole 123 formed in the passage forming substrate 114.

In addition, the vibration plate 115 is adhered to the opposite surface of the passage forming substrate 112, that is, the orifice surface of the pressure generating chamber 111, so each pressure generating chamber 111 is sealed by the vibration plate 115.

The vibration plate 115 comprises a composite plate 125 which is made up of an elastic membrane 124 and a support plate 125. The elastic membrane 124 is formed of, for example, an elastic member like resin film. The support plate 125 is formed of, for example, a metallic material. The elastic membrane 124 side is adhered to the passage forming substrate 112. In one example of the present embodiment, the elastic membrane 124 is formed of a polyphenylene sulfide (PPS) film, and the support plate 125 is formed of stainless steel (SUS). An island-shaped portion 126 in contact with a front end portion of the piezoelectric element 116 is provided within an area of the vibration plate 115 facing the respective pressure generating chamber 111. A thin-walled member 127 having a width smaller than those of other members is formed in an area of the vibration plate 115 facing the circumferential region of the respective pressure generating chamber 111, and the island-shaped portions 126 are provided on the thin-walled member 127. In the present embodiment, a compliance portion 128 of the thin-walled member, which is formed by etching the support plate 125 and is substantially made up only of a elastic membrane, is provided in the region of the vibration plate 115 facing the reservoir 121. In addition, when the pressure in the reservoir 121 is changed, the compliance portion 128 absorbs the changed pressure by transformation of the elastic membrane 124, so it keeps the pressure in the reservoir 121 to be constant.

The vibration plate 115 and a front end portion 150*a* of the partition wall 150 disposed at the side of the reservoir 121 form a first angular portion 18A, and the vibration plate 115 and a region 150*b* in the partition wall 150 partitioning the ink supply path 122 form a second angular portion 19A.

The adhesive agent 17A is continuously provided from the first angular portion 18A to the second angular portion 19A. The adhesive agent 17A provided on the first angular portion 18A gives the same effect that a fillet of the adhesive agent 17A is formed on the first angular portion 18A, so that it relieves stress on the first angular portion 18A. Using this configuration, although the front end portion 150*a* of the partition wall 150 has a narrow width and is vulnerable to stress destruction, the front end portion 150*a* is protected by the adhesive agent 17A. Therefore, even if the front end portion 150*a* of the partition wall 150 is stressed by bending of the nozzle plate 114, the stress is relieved to prevent destruction of the front end portion 150*a*. Even though the partition wall 150 and the vibration plate 115 are pulled by the bending of the nozzle plate 114, the adhesive agent 17A relieves the stress and prevents occurrence of cracks in the vibration plate 115.

The adhesive agent 17A is also provided to the second angle portion 19A, so that it prevents occurrence of cracks in a region 150*b* partitioning the ink supply path 122 of the partition wall 150 or in the vibration plate 115 of at a vicinity of the region 150*b*.

Furthermore, the adhesive agent 17A is continuously provided from the first angular portion 18*a* to the second angular portion 19A, and thus the first angular portion 18*a* and the second angular portion 19A are more strongly adhered by the adhesive agent 17A, so the region 150*b* and the front end portion 150*a* of the partition wall 150 can be more securely protected. Thus, even though cracks occur in the vibration plate 115 near the area of the first angular portion 18A and the second angular portion 19A, the first angular portion 18A and the second angular portion 19*a* are covered with the adhesive agent 17A, so ink is prevented from entering into cracks of the vibration plate 115.

In the present embodiment, the adhesive agent 17A is provided to an angular portion 152 formed by the island-shaped wall portion 151 and the vibration plate 115. According to this, it is possible to prevent cracks in a front end portion 151*a* of the island-shaped wall portion 151 or in a region 151*b* of the island-shaped wall portion 151 facing the partition wall 150, and also possible to prevent cracks in the vibration plate 115 near the front end portion 151*a* and the region 151*b*.

As mentioned above, crack occurrence is prevented in the region 150*b*, the front end portion 150*a* of the partition wall 150, and the vibration plate 115 near the region 150*b* and the front end portion 150*a*, thus an ink jet recording head with a high durability can be provided.

Furthermore, in the present embodiment, the adhesive agent 17A is made of, for example, epoxy resin or the like, and is applied to one surface of the nozzle plate 114. Here, when the nozzle plate 114 is adhered to the passage forming substrate 112, by a capillary phenomenon, the adhesive agent 17A flows from a front end portion 150*c* of the partition wall 150 to the vibration plate 115 disposed at opposite side. The adhesive agent 17A reaches the first angular portion 18A and the second angular portion 19A, and then is hardened. That is, the adhesive agent 17A is continuously provided from the end portion 150*c* to the second angular portion 19. Thus, the adhesive agent 17A is more consistently applied from the vibration plate 115 as compared with the case where the adhesive agent 17A is provided only at the first angular portion 18A or only from the first angular portion 18A to the second angular portion 19A. As a result, the first angular portion 18A and the second angular portion 19A can be more securely protected by the adhesive agent 17A. When the nozzle plate 114 is adhered to the passage forming substrate 112, the adhesive agent 17A arrives at the first angular portion 18A by the capillary phenomenon, therefore it is not necessary to perform a separate adhesive agent applying process from the end portion 150*c* to the first angular portion 18A, so the liquid ejecting head can be more efficiently manufactured, providing a lower cost liquid ejecting head.

In addition, it is also possible to provide grooves in the front end portion 150*a* of the partition wall 150 in the width direction. Using the grooves, the adhesive agent 17A applied on the nozzle plate 114 easily flows to the vibration plate 115 by the capillary phenomenon.

A front end of an active region of the piezoelectric element 116 constituting the piezoelectric element unit 117 is fixed, so as to be in contact with the island-shaped portion 126 of the vibration plate 115.

In this embodiment, the piezoelectric element 116 that is a pressure generating device for generating pressure for discharging ink droplet is integrally formed as the piezoelectric element unit 117. That is, a piezoelectric element forming member 132 is formed by vertically and alternately forming layers of a piezoelectric material 129 and electrode forming materials 130, 131. Each piezoelectric element 116 is formed by separating the piezoelectric element forming member 132 in the form of comb teeth corresponding to the respective pressure generating chambers 111. In other words, in the present embodiment, a plurality of the piezoelectric elements 116 are integrally formed. Meanwhile, an inactive region, which is not involved in vibration of the piezoelectric element 116, a base end of the piezoelectric element 116 is fixed to a fixing substrate 133. A circuit substrate 135 having wirings 134 which provide signals for driving the respective piezoelectric elements 116 is connected to the vicinity of the base end of the piezoelectric element 116 opposite to the fixing substrate 133. In the present embodiment, the piezoelectric element unit 117 comprises the piezoelectric element 116 (or the piezoelectric element forming member 132), the fixed substrate 133, and the circuit substrate 135.

The front end of the piezoelectric element 116 of the piezoelectric element unit 117 is fixed so as to be in contact with the island-shaped portion 126 of the vibration plate 115. For example, in the present embodiment, as described above, the head case 119 is fixed to the vibration plate 115, and the piezoelectric element unit 117 is received inside the receiving portion 118 of the head case 119. The fixing substrate 133 having the piezoelectric element 116 fixed thereto is fixed to the head case 119 opposite to the piezoelectric element 116.

In the head case 119, a plurality of the receiving portions 118 receiving the piezoelectric element unit 117 (FIG. 5 shows one receiving portion) are installed, and one piezoelectric element unit 117 is disposed in one receiving portion 118.

A wiring substrate 137 is fixed in the head case 119. The wiring substrate 137 includes a plurality of conductive pads 136 to which the wirings 134 of the circuit substrate 135 are connected respectively. As a result, the receiving portion 118 of the head case 119 is substantially closed by the wiring substrate 137. The wiring substrate 137 includes a slit-shaped opening 138 formed in a region facing the receiving portion 118 of the head case 119. Therefore, the circuit substrate 135 is provided to appear outside the receiving portion 118 from the opening portion 138 of the wiring substrate 137.

In the present embodiment, the circuit substrate 135 comprising the piezoelectric element unit 117 includes a flexible printed circuit (FPS) substrate to which a driving IC (not shown) for driving the piezoelectric element 116 is provided, such as a tape carrier package (TCP), a chip on film (COF) and a flexible flat cable (FFC) or the like. The base end portion of the respective wiring 134 of the circuit substrate 135 is connected to the electrode forming materials 130, 131 which comprise the piezoelectric element 116 by means of, for example, a solder, an anisotropic conductive material or the like. The front end of the respective wiring 134 of the circuit substrate 135 is connected to the conductive pads 136 of the wiring substrate 137. Specifically, the front end portion of the circuit substrate 135 extending from the opening portion 138 of the wiring substrate 137 to the outside of the receiving portion 118 bends along the surface of the wiring substrate 137. The wirings 134 are connected to the conductive pads 136 of the wiring substrate 137 respectively by soldering (not shown).

The ink jet recording head changes the volume of the corresponding pressure generating chamber 111 by driving the piezoelectric element 116 and the vibration plate 115, causing an ink droplet to be discharged from a predetermined nozzle opening 113. Specifically, when ink is supplied to the reservoir 121 from an ink cartridge (not shown), ink is distributed to corresponding pressure generating chamber 111 by way of the ink supply path 122. By applying a voltage to the piezoelectric element 116, the piezoelectric element 116 is contracted. The vibration plate 115 is moved with the piezoelectric element 116, causing the volume of the pressure generating chamber 111 can be increased, as a result, ink is drawn to the pressure generating chamber 111. After ink is filled inside the pressure generating chamber 111 to the nozzle opening 113, voltage applying to the electrode forming materials 130, 131 of the piezoelectric element 116 is stopped according to a recording signal supplied through the wiring substrate 137. So, the piezoelectric element 116 is extended to return to the original state, and the vibration plate 115 is also moved to return to the original state. Consequently, the volume of the pressure generating chamber 111 is contracted, and then the pressure inside the pressure generating chamber 111 is increased such that ink is discharged from the nozzle orifice 113.

Other Embodiments

Although the invention has been described above with reference to two embodiments, the invention is not limited to the above described embodiments, and other embodiments may be used without departing from the meaning and scope of the invention.

In the first and the second embodiments, while the adhesive agents 17, 17A are continuously provided to the nozzle plates 20, 114 and the passage forming substrates 10, 112, in an alternative configuration the adhesive agents 17, 17A can be separately provided. That is, after the adhesive agents 17, 17A are applied to the first angular portions 18, 18A and the second angular portions 19, 19A respectively, the nozzle plates 20, 114 can be adhered to the passage forming substrates 10, 112. In this case, since the adhesive agents 17, 17A are provided to the first angular portions 18, 18A and the second angular portions 19, 19A, stress on the front end portion 11*a*, 150*a* and the region 11*b*, 150*b* of the partition wall 11, 150 is relieved, so it is possible to prevent cracks.

Figure 7:
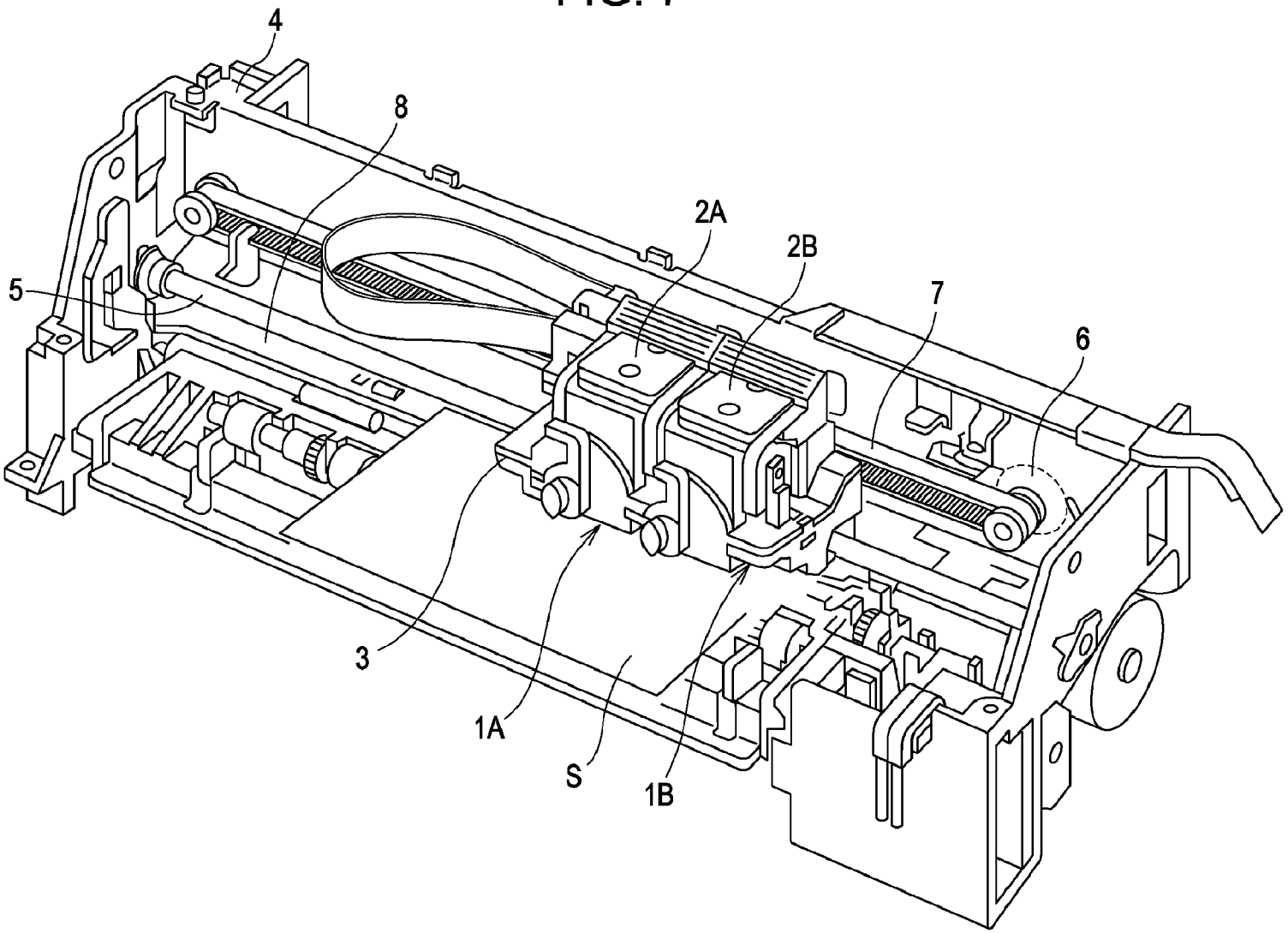
FIG. 7 is a schematic view showing an example of the ink jet recording apparatus related to another embodiment of the invention.

The ink jet recording head of the above-mentioned embodiment constitutes a part of a recording head unit including an ink passage that communicates with an ink cartridge and the like, and is disposed in an ink jet type recording apparatus. FIG. 7 is a schematic view showing an example of the ink jet type recording apparatus. As shown, ink cartridges 2A and 2B serve as an ink supply unit and are detachably installed to recording head units 1A and 1B having ink jet recording heads. A carriage 3 in which the recording head units 1A and 1B is installed is provided such that the carriage 3 can move freely to axial direction of a carriage axis 5 disposed in a main body 4 of the apparatus. The recording head units 1A and 1B, for example, discharge a black ink composition and a color ink composition, respectively. A driving force of a driving motor 6 is transmitted to the carriage 3 by intervention of a plurality of gears (not shown) and a timing belt 7, so that the carriage 3 having the recording head units 1A and 1B mounted thereon moves along the carriage axis 5. In the meanwhile, since a platen 8 is disposed along the carriage axis 5 in the main body 4 of the apparatus, a recording sheet S, which is a recording medium fed by a sheet feeding roller (not shown), is transported on the platen 8.

In addition to the above described embodiments which describe an ink jet recording head, the basic configuration of the liquid ejecting head can also be applied not only to general liquid ejecting heads, but also to apparatuses ejecting liquid other than ink. The liquid ejecting head includes, for example, various recording heads used in image recording apparatuses such as a printers or the like, color material ejecting heads used for manufacturing a color filter such as a liquid crystal display or the like, an electrode material ejecting heads used for forming electrode of an organic EL display, an electric field display or the like, and a bio organic substance ejection heads used for manufacturing a bio-chip.

What is claimed is:

1. A liquid ejecting head comprising:

a first base member including:

a plurality of pressure generating chambers communicating with respective nozzle openings from which liquid is ejected, and a plurality of parallel partition walls which partition the pressure generating chambers;

a second base member disposed on one surface of the first base member;

a reservoir serving as a common liquid chamber for the pressure generating chambers; and an adhesive agent adhered to a first angular portion formed in an end portion of the partition walls near the reservoir which is adjacent to the second base member.

2. The liquid ejecting head according to claim 1, wherein the first base member further comprises a flow passage partitioned by the partition walls which communicate with the reservoir and the pressure generating chambers, and wherein the adhesive agent is adhered to a second angular portion formed in the partition walls partitioning the flow passage which is adjacent to the second base member.

3. The liquid ejecting head according to claim 2, wherein the adhesive agent is continuously provided from the first angular portion to the second angular portion.

4. A liquid ejecting apparatus comprising a liquid ejecting head according to claim 1.

5. A liquid ejecting head comprising:

a first base member including:

a plurality of pressure generating chambers communicating with respective nozzle openings from which liquid is ejected, a flow passage communicating with the pressure generating chambers, and a plurality of parallel partition walls which partition the pressure generating chambers and flow passage;

a second base member disposed on one surface of the first base member;

a reservoir serving as a common liquid chamber for the pressure generating chambers which communicates with the pressure generating chambers via the flow passage; and an adhesive agent adhered to a first angular portion formed in an end portion of the partition walls near the reservoir which is adjacent to the second base member and a second angular portion formed in the partition walls partitioning the flow passage which is adjacent to the second base member, wherein the first angular portion and second angular portion have groove portions formed therein which cause the adhesive agent to flow from the first angular portion to the second angular portion using capillary action.

* * * * *